US005947748A

United States Patent [19]

Licht et al.

[11] Patent Number: 5,947,748

[45] **Date of Patent: *Sep. 7, 1999**

[54] CONNECTOR FOR PROGRAMMABLE LOGIC CONTROLLER HAVING MODIFIABLE TERMINATION THEREFOR

[75] Inventors: Harold Licht; Steven Lawrence, both of Johnson City; Norman Schultz, Elizabethon; Garland Spears, Johnson City, all of Tenn.

[73] Assignee: Siemens Energy & Automation, Inc., Alpharetta, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,257

[22] Filed: Mar. 6, 1997

Related U.S. Application Data

[63] Continuation of application No. 08/723,072, Sep. 30, 1996, abandoned.

[51] Int. Cl.[6] ..... H01R 9/09

[52] U.S. Cl. ..... 439/59; 439/629; 439/951

[58] Field of Search ..... 439/59, 76.1, 79, 439/629, 951, 638, 639

[56] References Cited

U.S. PATENT DOCUMENTS

| | | | |
|---|---|---|---|
| 2,995,686 | 8/1961 | Selvin | 317/101 |
| 3,842,212 | 10/1974 | Miller | 179/91 R |
| 3,922,051 | 11/1975 | Reynolds | 439/59 |
| 4,547,840 | 10/1985 | Tinder | 439/56 |
| 4,760,375 | 7/1988 | Stecker | 439/59 |
| 4,862,325 | 8/1989 | Ohashi | 439/59 |
| 4,919,626 | 4/1990 | Anhalt et al. | 439/59 |
| 5,016,005 | 5/1991 | Shaw et al. | 340/870.19 |
| 5,227,165 | 7/1993 | Oogita | 439/59 |
| 5,253,140 | 10/1993 | Inoue et al. | 361/728 |
| 5,288,249 | 2/1994 | Fitzgerald | 439/56 |
| 5,411,416 | 5/1995 | Balon et al. | 439/639 |
| 5,509,827 | 4/1996 | Huppenthal et al. | 439/638 |

FOREIGN PATENT DOCUMENTS

| | | |
|---|---|---|
| 0 599 362 A2 | 10/1993 | European Pat. Off. . |
| 0 713 360 A2 | 1/1994 | European Pat. Off. . |

OTHER PUBLICATIONS

700 IBM Technical Disclosure Bulletin, vol. 31, No. 11, Apr. 1989.

International Search Report Dated Dec. 19, 1997.

*Primary Examiner*—Paula Bradley
*Assistant Examiner*—Tho D. Ta

[57] ABSTRACT

A connection scheme for a Programmable Logic Controller is taught. Briefly stated, a printed circuit board having a plurality of electrically conductive traces therein and a plurality of electrically conductive fingers associated with the conductive traces is disclosed. The pitch and size of the conductive fingers coincide with that of a PLC I/O connector. One or more of a plurality of interconnective devices may be connected to the printed circuit board thereby minimizing adverse thermal effects from adjacent thermocouple wires or providing for use of various interconnection devices or signal conditioning such as switches, displays, discrete devices and the like.

9 Claims, 1 Drawing Sheet

CONNECTOR FOR PROGRAMMABLE LOGIC CONTROLLER HAVING MODIFIABLE TERMINATION THEREFOR

This is a continuation, of application Ser. No. 08/723,072 filed Sep. 30, 1966 now abandoned.

FIELD OF THE INVENTION

This invention relates, generally, to connectors for Programmable Logic Controllers and more particularly to a connector having means for physical and/or electrical conditioning or input leads.

BACKGROUND OF THE INVENTION

Programmable Logic Controllers (PLC's) are being used more and more frequently as their cost and size decrease. This increased usage is also due to increased functionality while at the same time a dramatic increase in the number and types of operating systems which a PLC may cooperate with as well as software tools which greatly facilitate the writing of appropriate instruction sets.

Accordingly, PLC's once installed are likely to be modified or adapted on the fly with, for example, new operating instructions, additional input/output (I/O) instructions and signals, particularly instrumentation. As a result of this PLC's are being used in many more applications.

Although many types of inputs are commonly connected to PLC's, on of the most frequent is from analog transducers or instruments, the most frequent typically being thermocouples used for temperature measurements. However, also increasing in usage are analog transducer inputs from devices such as tank gauges. However, what is common is that these types of devices are analog and, particularly in the use of thermocouples produce or dissipate heat. Moreover, since these inputs are analog, anything which affects the transducer input, or adjacent transducer inputs may result or inaccuracy. Therefore, this inaccuracy must either be accepted or compensated for so that the program in the PLC will properly operate.

It is generally known that acceptance of inaccuracies is only acceptable in only the most limited of situations. Therefore, designers are left with the solution of predetermining what those inaccuracies and compensating for them.

Another problem associated with PLC inputs is that users typically have a choice of digital or analog inputs which are not definable but are hardware driven. While this typically does not present a problem upon initial design and implementation, it is problematic when instrumentation is changed or added. There, the user must condition the instrumentation at its point of use since, that is an analog signal must be digitized if only digital inputs are available on the PLC. Similarly, the reverse occurs where PLC outputs are concerned.

Also, due to packaging constraints, particularly among the newer "brick" size PLC's, the connector for input/output (I/O) connections occupies the entire front usable space of each module. This leaves little or no space for various other items such as logic connector switches, potentiometers, fuses or operator interface items. This size problem is particularly acute due to thermal variations between the upper and lower portions of the connector due to thermal transfer between the connector contacts and the module or PLC. It is known that in order to accurately design thermocouple PLC modules, the reference thermocouple wires must be held at relatively the same temperature throughout its length in order to maintain a consistent and stable junction temperature. Therefore, crowding of thermocouple wires or the simple intermixing of simple analog wires with thermocouple wires frequently results in very poor thermal characteristics which give upper contacts much higher temperature readings than lower contacts.

Accordingly, it is desirable and an object of the present invention to produce a device which minimizes thermal gradients between different portions of the I/O contacts.

It is also desirable and an object of the present invention to produce a device which allows for the use of additional components adjacent the PLC such as, potentiometers, switches, displays, other types of connectors and the like.

Still a further object of the present invention is to produce a device which allows for signal conditioning into or out of the PLC.

Finally, it is yet another object of the present invention to produce a connector for use with a Programmable Logic Controller (PLC), comprising an interface connector board consisting of a plurality of conductive paths thereon, the interface connector board having an edge and a planar surface disposed at an angle with respect to the edge; a plurality of conductive contact fingers which are at a spacing which is different than that of said conductive paths, each of which being connected to at least one of said plurality of conductive paths, the plurality of conductive fingers disposed along the edge of the interface connector board; and at least one secondary interface device disposed on the planar surface, the secondary interface device electrically connected to at least one of said plurality of conductive paths contained on the interface connector board.

BRIEF DESCRIPTION OF THE DRAWINGS

Reference may be now had to the accompanying drawing in which.

DETAILED DESCRIPTION OF PREFERRED EMBODIMENT

Figure 1:
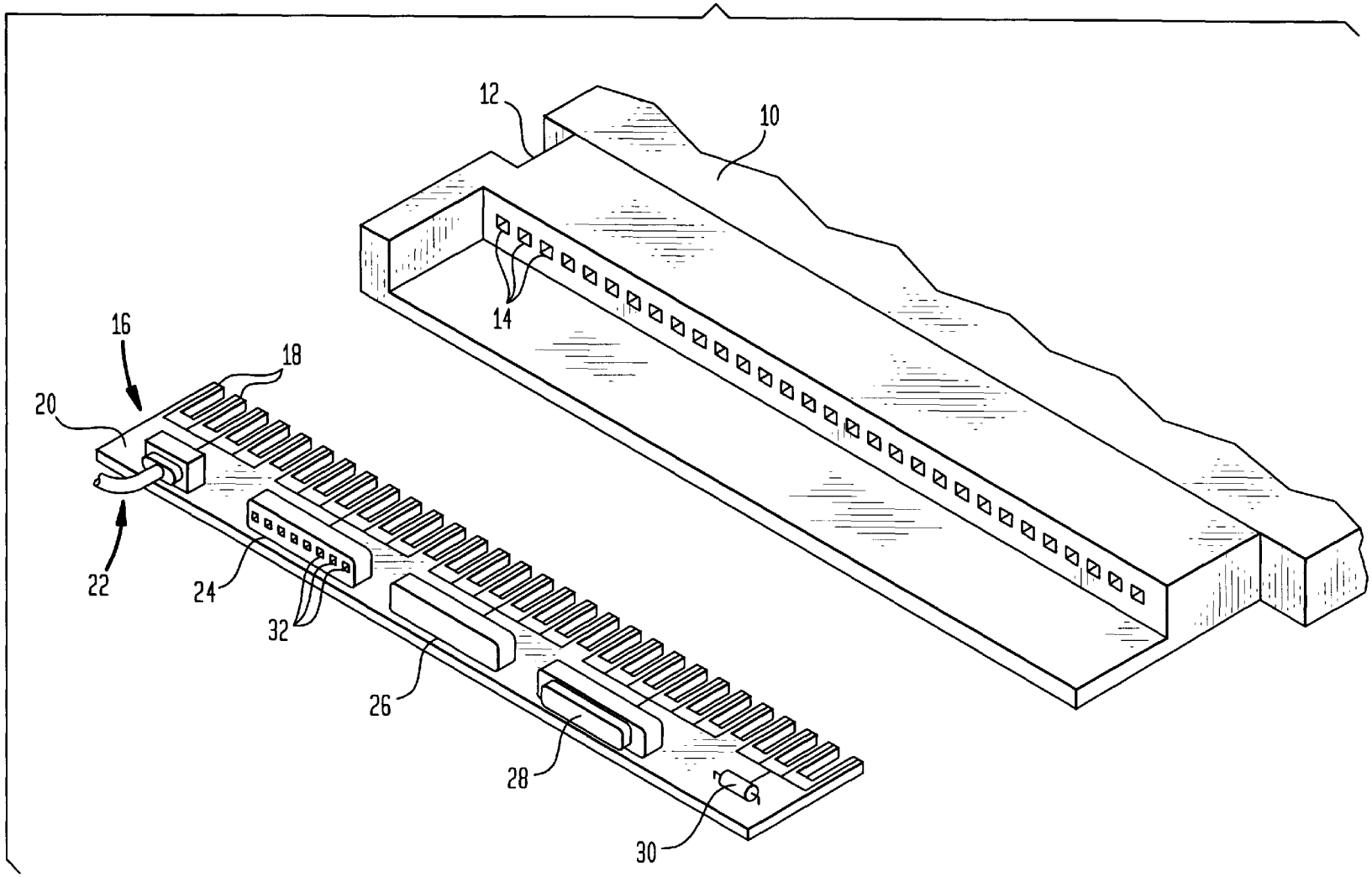
FIG. 1 is a diagrammatic representation of interconnection scheme according to the present invention.

Referring now to FIG. 1 there is shown a diagrammatic representation of the interconnection scheme of the present invention. More particularly, shown is a Programmable Logic Controller (PLC) 10 shown in phantom. It is to be understood that any type of PLC may be utilized without departing from the spirit and scope of the present invention. For example, such PLC's may be an S7 type produced by Siemens Energy & Automation, Inc. Of Atlanta, Georgia. Associated with the PLC 10 is a PLC input/output (I/O) connector block 12. It is to be understood that connector block 12 in the preferred embodiment of the present invention is the connector scheme provided by the PLC manufacturer. However, connector block 12 may be an intermediate connector block which provides different contact spacing between the PLC and the end connector scheme. Associated with connector block 12 are a plurality of PLC I/O contact points 14, with the number, size and spacing (pitch) depending upon the specific PLC.

Shown adjacent the connector block is the interface connector board 16 according to the preferred embodiment of the present invention. In the preferred embodiment of the present invention, interface connector board 16 is comprised of a printed circuit (PC) board 20 which may be of any suitable or desirable type such as, for example, single or multi layered and accommodating surface mounted and/or plated through component mounting. Disposed along one edge of PC board 20 are plated fingers 18. The size, number and pitch of fingers 18 is configured so as to correspond with the PLC I/O contact points 14 associated with the PLC.

Further, although plated fingers 18 are shown, it is to be understood that discrete contact fingers (not shown) may be soldered by any acceptable means onto the edge of PC board 20 in order to provide contact fingers. Disposed on PC board 20 are a plurality of interconnection devices. Included are a toggle or dip switch 22, a connector 24 (which may be either a screw terminal type or friction fit such as zero or low insertion, ZIF/LIF connector), a display device 26, a D-type connector 28 or a discrete component 30. It is to be understood that discrete component 30 may be one or more passive or active components or a combination thereof. Connected to connector 24 are thermocouple wires 32 which lead to equipment (not shown) cooperating with the PLC 10.

In this manner it can be seen that use of interface connector board 16 allows for more room between adjacent connection points while also allowing for even distribution between thermocouple wires. This has been found to greatly minimize excessive or unwanted thermocouple wire heating. Additionally, it allows for substantially increased dielectric isolation between adjacent contacts. Further, it allows the user to easily customize a plurality of interconnection methods or components thereby allowing for signal conditioning such as, for example, A-D or D-A conversion, appropriate gain or impedance levels and the like without having to use different PLC I/O combinations which may not even be available by the manufacturer.

It is to be understood that may variations of the present invention may be practiced without departing from the spirit and scope of the present invention and the scope of protection is to be limited by the claims appended hereto.

What is claimed is:

1. A user-modifiable interface connector interfacing a microprocessor-based Programmable Logic Controller (PLC) with a device separate from and external to the PLC while providing the capability to sample and condition analog signals associated with the external device, said connector comprising:

a connector board having an edge and a planar surface, said connector board being accessible to and modifiable by the user;

a plurality of conductive contact fingers being disposed along said edge of said connector board, each one of the conductive contact fingers coupled to PLC, each one of the conductive contact fingers configured to exchange only conditioned analog signals with the PLC;

a connector disposed on said planar surface and coupled to the external device in addition to any connection between the PLC and the connector board to exchange unconditioned analog signals with the external device; and a combination of components being disposed on said planar surface, said combination of components being coupled to said connector to exchange unconditioned analog signals with said connector, said combination of components configured to condition the unconditioned analog signals from the external device, said combination of components being electrically connected to at least one of said plurality of conductive contact fingers.

2. The connector of claim 1, wherein the PLC having an I/O interconnection connector which has a plurality of discrete connection points, each one of the discrete connection points receiving one of the conductive contact fingers.

3. The connector of claim 1 wherein said connector board is a printed circuit board.

4. The connector of claim 3 wherein said conductive fingers are plated portions of said printed circuit board.

5. A user modifiable interface connector interfacing a microprocessor-based Programmable Logic Controller (PLC) to a sensor separate from and external to the PLC while providing the capability to sample and condition analog signals associated with the external sensor, said connector comprising:

a connector board having an edge and a planar surface, said connector board being accessible to and modifiable by the user;

a plurality of conductive contact fingers being disposed along said edge of said connector board, each one of the conductive contact fingers coupled to the PLC, each one of the conductive contact fingers configured to exchange only conditioned analog signals with the PLC;

a connector disposed on said planar surface and coupled to the external sensor in addition to any connection between the PLC and the connector board to exchange unconditioned analog signals with the external sensor;

a combination of components disposed on said planar surface, said combination of components being coupled to said connector to exchange unconditioned analog signals with said connector, and configured to condition the unconditioned analog signals from the external sensor, said combination of components being electrically connected to at least one of said plurality of conductive fingers; and the PLC having an I/O interconnection connector having a plurality of discrete connection points and wherein said plurality of conductive fingers are in communication with said plurality of discrete connection points.

6. A user-modifiable interface connector interfacing a microprocessor-based PLC to at least one thermocouple while providing the capability to sample and condition analog signals associated with the thermocouple, the thermocouple being located externally to and independent from the PLC, and the PLC having at least one contact point, said connector comprising:

(a) a connector board including at least one contact fmgers for connection with the contact point, said contact finger coupled to the PLC and configured to exchange only conditioned analog signals with the PLC;

(b) at least one thermocouple connector being disposed on said connector board and coupled to the thermocouple in addition to any connection between the PLC and the connector board to exchange unconditioned analog signals with the thermocouple;

(c) a combination of components being disposed on said connector board in communication with the at least one contact finger, and coupled to said thermocouple connector to exchange unconditioned analog signals with said thermocouple connector, said combination of components configured to condition the unconditioned analog signals from the thermocouple for processing by the PLC, and said combination of components accessible to and modifiable by the user.

7. The connector of claim 6, wherein said combination of components includes at least one DIP switch.

8. The connector of claim 6, wherein said combination of components includes at least one display device.

9. A user-modifiable interface connection comprising:

a microprocessor-based Programmable Logic Controller (PLC), a device separate from and external to the PLC, a connector board having an edge and a planar surface, said connector board being accessible to and modifiable by the user;

a plurality of conductive contact fingers being disposed along said edge of said connector board, each one of the conductive contact fingers coupled to the PLC, each one of the conductive contact fingers configured to exchange only conditioned analog signals with the PLC;

a connector disposed on said planar surface and coupled to the external device in addition to any connection between the PLC and the connector board to exchange unconditioned analog signals with the external device; and a combination of components being disposed on said planar surface, said combination of components being coupled to said connector to exchange unconditioned analog signals with said connector, said combination of components configured to condition the unconditioned analog signals from the external device, and said combination of components being electrically connected to at least one of said plurality of conductive contact fingers.

* * * * *